US011008694B2

(12) United States Patent
Park et al.

(10) Patent No.: US 11,008,694 B2
(45) Date of Patent: May 18, 2021

(54) LAUNDRY APPARATUS

(71) Applicant: LG ELECTRONICS INC., Seoul (KR)

(72) Inventors: Bio Park, Seoul (KR); Jaehyuk Jang, Seoul (KR); Sangwook Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 182 days.

(21) Appl. No.: 15/651,689

(22) Filed: Jul. 17, 2017

(65) Prior Publication Data

US 2018/0057996 A1 Mar. 1, 2018

(30) Foreign Application Priority Data

Aug. 25, 2016 (KR) ..... 10-2016-0108328

(51) Int. Cl.
*D06F 39/04* (2006.01)
*D06F 37/04* (2006.01)
(Continued)

(52) U.S. Cl.
CPC ..... *D06F 39/04* (2013.01); *D06F 37/04* (2013.01); *D06F 37/267* (2013.01); *D06F 37/304* (2013.01)

(58) Field of Classification Search
CPC ..... D06F 37/04; D06F 37/267; D06F 37/304; D06F 39/04
See application file for complete search history.

(56) References Cited

U.S. PATENT DOCUMENTS 3,358,302 A 12/1967 Candor
4,181,846 A * 1/1980 Cunningham ..... D06F 58/26 219/619
(Continued)

FOREIGN PATENT DOCUMENTS

CN 1766215 A 5/2006
CN 201722528 U 1/2011
(Continued)

OTHER PUBLICATIONS

International Search Report dated Sep. 26, 2017 issued in Application No. PCT/KR2017/006825.
(Continued)

*Primary Examiner* — Joseph L. Perrin
(74) *Attorney, Agent, or Firm* — KED & Associates LLP

(57) ABSTRACT

A laundry apparatus is provided. The laundry apparatus may include a cabinet, a tub provided in the cabinet and defining an internal space, the tub having an opening formed in a front of the tub, a drum rotatably provided in the internal space of the tub and being made of a conductor, and an induction heater provided at an outer circumferential surface of the tub. The induction heater may heat the drum by generating an electromagnetic field and may include a coil that uses a supplied electric current to generate an eddy current in the drum by generating a magnetic field, and a coil arranging portion provided at the outer circumferential surface of the tub. The coil may be arranged on the coil arranging portion such that coils of the coil are spaced a predetermined distance apart from each other while being wound from a front direction to a rear direction of the tub.

20 Claims, 9 Drawing Sheets

(51) Int. Cl.
*D06F 37/26* (2006.01)
*D06F 37/30* (2020.01)

(56) References Cited

U.S. PATENT DOCUMENTS

| | | | |
|---|---|---|---|
| 5,935,471 | A | 8/1999 | St. Louis |
| 2007/0125133 | A1 | 6/2007 | Oh et al. |
| 2011/0089944 | A1 | 4/2011 | Shih et al. |
| 2012/0248095 | A1 | 10/2012 | Lee et al. |

FOREIGN PATENT DOCUMENTS

| | | | | | |
|---|---|---|---|---|---|
| CN | 202000148 | U | | 10/2011 | |
| DE | 10 2008 043 281 | | | 5/2010 | |
| DE | 102009026646 | A1 | * | 12/2010 | ..... D06F 58/02 |
| DE | 1020142085414 | A1 | | 11/2015 | |
| DE | 10 2016 110859 | | | 6/2017 | |
| EP | 2100996 | | | 9/2009 | |
| EP | 1914339 | | | 3/2010 | |
| EP | 2 400 052 | | | 12/2011 | |
| EP | 2424329 | A2 | | 2/2012 | |
| JP | S 61-58694 | A | | 3/1986 | |
| JP | H 08-98990 | | | 4/1996 | |
| JP | 08-252393 | | | 10/1996 | |
| JP | 2001-070689 | A | | 3/2001 | |
| JP | 2003-288976 | A | | 10/2003 | |
| JP | 2005177331 | A | * | 7/2005 | |
| JP | 4784130 | B2 | | 10/2011 | |
| KR | 10-2003-0097555 | | | 12/2003 | |
| KR | 10-0446763 | B1 | | 9/2004 | |
| KR | 10-0922986 | B1 | | 10/2009 | |
| KR | 10-2010-0129160 | A | | 12/2010 | |
| KR | 10-1010427 | | | 1/2011 | |
| KR | 10-01450238 | B1 | | 10/2014 | |
| KR | 10-1596482 | B1 | | 3/2016 | |

OTHER PUBLICATIONS

European Search Report dated Jan. 26, 2018 issued in Application No. 17182359.4.
Chinese Office Action dated Oct. 10, 2020 issued in Application 201710646214.X.

* cited by examiner

LAUNDRY APPARATUS

CROSS-REFERENCE TO RELATED APPLICATION

This application claims priority under 35 U.S.C. § 119 to Korean Application No. 10-2016-0108328 filed on Aug. 25, 2016, whose entire disclosure is incorporated herein by reference.

BACKGROUND

1. Field

A laundry apparatus and a laundry apparatus including an induction heater are disclosed herein.

2. Background

A laundry apparatus or a washing machine is an electric appliance configured to wash clothes, bedding or other items (hereinafter, "laundry") through washing, rinsing, and spinning so as to remove dirt and contaminants, using water, detergent, and mechanical action. A washing machine may raise a temperature of wash water so as to enhance washing efficiency and to enhance a sterilization treatment effect for laundry. For the washing and laundry sterilization effects, heated or warm water may be directly supplied to the washing machine from an external water supply source to raise the temperature of the wash water, or an auxiliary heater may be provided and heat the wash water in which the laundry is submerged so as to indirectly raise the temperature of the laundry.

It may be inconvenient to supply wash water to the washing machine to a water level at which all of the laundry is submerged so as to raise the temperature of the wash water. It may also be inconvenient to heat not only the laundry but also the wash water so as to raise the temperature of the laundry. Wash water has to be supplied or heated, which could cause waste of materials and energy.

A dryer is an electric appliance configured to dry wet laundry by exposing the laundry to a high temperature. The dryer may expose laundry to hot air heated using a heater and evaporate water contained in the laundry. Dryers may be categorized into an exhaustion type dryer and a circulation type dryer which heat air using a heater to generate heated-air and expose the heated air to the laundry.

However, heated air may fail to be uniformly supplied to the laundry. For example, a large amount of laundry or entangled laundry may not be exposed to the heated air uniformly so that drying efficiency might deteriorate disadvantageously. While heated air is supplied to the laundry, which may be partially wet, so as to dry the laundry completely, the heated air may also be continuously supplied even to completely-dried laundry and may result in damaging laundry.

BRIEF DESCRIPTION OF THE DRAWINGS

Embodiments will be described in detail with reference to the following drawings in which like reference numerals refer to like elements, and wherein.

DETAILED DESCRIPTION

Figure 1A:
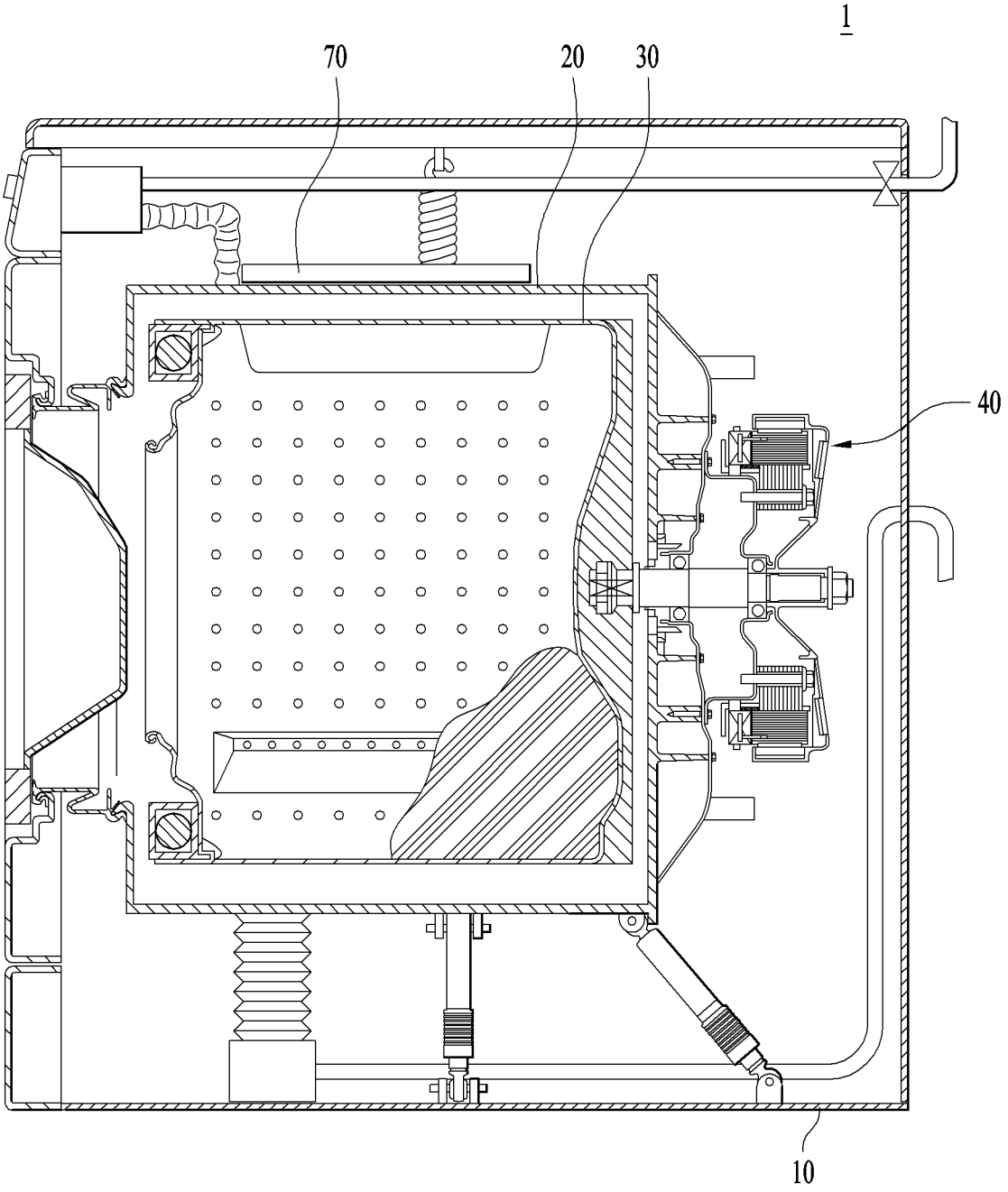
FIG. 1A and FIG. 1B illustrate a laundry apparatus an induction heater in accordance with an embodiment.
Figure 1B:
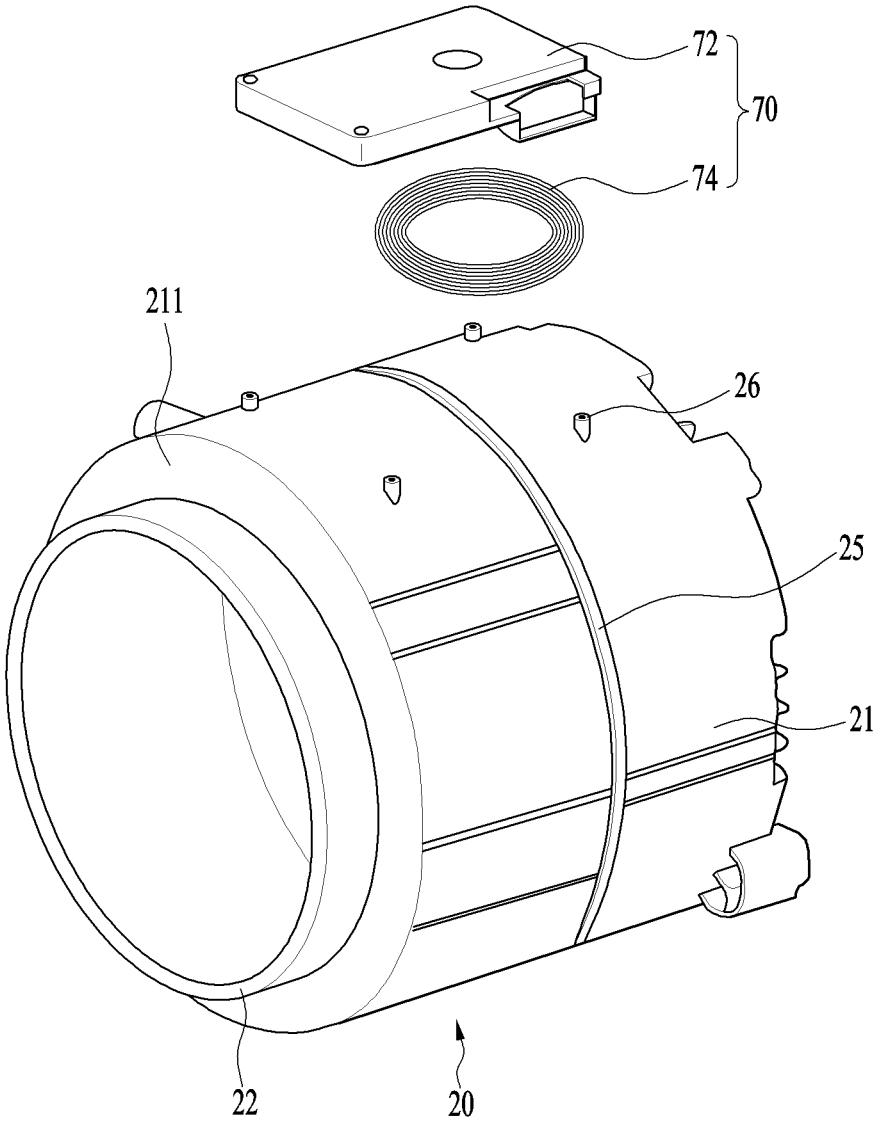

As shown in FIG. 1A and FIG. 1B, a laundry apparatus 1 may include a cabinet 10 that defines an exterior of the laundry apparatus, a tub 20 provided in the cabinet 10 and defining a space, with an opening provided in a front, a drum 30 with a predetermined region made of metal and rotatably provided in the space to hold laundry, and an induction heater or device 70 provided in or at an outer circumferential surface of the tub 20 and configured to heat the drum 30 using an electromagnetic field. The tub 20 may be formed in a cylindrical shape to rotatably accommodate the drum 30. An opening may be provided in or at one end of the cylindrical tub.

The laundry apparatus 1 may further include a drive unit or drive 40 configured to rotate the drum within the tub 20. The drive unit 40 may be provided as a motor and include a stator and a rotor. The rotor may be connected to a shaft 42 and the shaft 42 may be connected to the drum 30 so as to rotate the drum 30 within the tub 20. A configuration of the drive unit 40 and technical features about how the drive unit 40 rotates the drum 30 are well known. Accordingly, a detailed description of the configuration and technical features have been omitted.

The induction heater 70 may directly heat the drum 30. The induction heater 70 may include a coil 74 capable of generating an eddy current by generating a magnetic field using an electric current supplied thereto and a loading portion 72 for loading the coil 74. The coil loading portion 72 may be a ferromagnetic material so as to maintain a shape of the coil 71 safely and guide the magnetic field generated in the coil 71 in one direction. For example, the coil loading portion 72 may be formed in a box shape with one open side.

The coil 71 may directly heat the drum 30 so as to raise not only a temperature of the drum 30 but also a temperature inside of the drum 30. Once currents start to flow in the coil 71, a magnetic field may be generated along a radial direction with respect to the coil 71. When electric currents are supplied to the coil 71, which may be wound in a circular shape, a circular-shaped magnetic field may be generated, and the circular-shaped electromagnetic field may pass through a center of the coil.

An alternating current, a phase contrast of which may differ, may pass through the coil 71, an alternating magnetic field, in which a direction of an alternating current is changed, may be formed, and the alternating magnetic field may create an opposite-direction induced magnetic field in a neighboring conductor. The change of the induction magnetic field may generate an induced current in the conductor. The induced current and the induction magnetic field may be understood as inertia to change of the electric field and magnetic field.

For example, when the drum 30 is provided as a conductor, an eddy current or vortex current, which is a kind of induced current, may be generated in the drum 30 by the induction magnetic field generated in the coil 71. The eddy current may be converted into heat while being dissipated by resistance of the drum 30 as the conductor. As a result, the drum 30 may be heated by the heat and the temperature inside the drum 30 may rise as the drum 30 is heated. When the drum 30 is provided as a conductor made of a magnetic material, such as, for example, Fe, the alternating current of the coil 71 provided in the tub 30 may be capable of heating the drum 30.

The induction heater 70 including the coil 71 and the coil loading portion 72 may be provided in or at an outer circumferential surface of the tub 20. Strength of the magnetic field may decrease according to distance so that it may be advantageous to provide the induction heater 70 in or at the outer circumferential surface of the tub 20 and narrow a gap with the drum 30. However, the drum 30 may hold wash water, and vibration may be generated by rotation of the drum 30. Thus, with this embodiment, the induction heater 70 is shown provided at an outer circumferential surface of the tub 20.

The laundry apparatus may be configured to wash or dry clothes and bedding and other items (hereinafter, "laundry") while the drum is rotating. The tub 20 may be provided in a cylindrical shape. For example, the coil 71 may be wound around or at a location of the outer circumferential surface of the tub at least one time.

When the coil 71 is wound at the outer circumferential surface of the tub 20, there may be too much of the coil 71, and wash water flowing from the drum 30 may contact the coil 71, causing an accident like a short circuit. When the coil 71 is wound at the outer circumferential surface of the tub 20, the induction magnetic field may be generated in the opening 22 of the tub 30, and the drive unit 40 might fail to directly heat the outer circumferential surface of the tub 20.

Accordingly, the coil 71 may be provided in or at an outer circumferential surface of the tub 20, for example, only in a predetermined region of the outer circumferential surface of the tub 20. The coil 71 may be wound not around an entire region of the outer circumferential surface but a predetermined area from a front side to a rear side at least one time.

FIG. 1A and FIG. 1B show that the induction heater 70 is provided in or at an upper portion of the tub 20. However, embodiments do not exclude that it may be provided in one or more of upper, lower, and lateral portions of the tub 20. The induction heater 70 may be provided in or at the predetermined area of the outer circumferential surface of the tub 20, and the coil 71 may be wound around the surface between the induction heater 70 and the tub 20 at least one time. With such a structure mentioned above, the induction heater 70 may directly emit the induction magnetic field to the outer circumferential surface of the drum 30 and then may generate the eddy current in the drum 30 only to directly heat the outer circumferential surface of the drum 30.

The induction heater 70 may be connected with a power supply source by wire to be provided with power, or it may be connected with a controller to control operation of the laundry apparatus 1 provided with power. Only if capable of supplying electric power to the coil 71, the induction heater 70 may be supplied with power from any unit. The electric power may be supplied to the induction heater 70 and the alternating current may flow to the coil 71 provided in the induction heater 70. After that, the drum 30 may start to be heated.

Unless the drum 30 is rotated, only one surface of the drum 30 may be heated such that the heated surface might overheat, while another surface may be heated a little or not heated at all. The heat may not be supplied to the laundry held in the drum 30 smoothly and efficiently. Accordingly, when the induction heater 7 is put into operation, the drive unit 40 may be driven to rotate the drum 40.

A rotation speed of the drum 30 rotated by the drive unit 40 may be variable and may depend on if all areas of the outer circumferential surface of the drum 30 is able to face the induction heater 70. As the drum 30 is being rotated, all of the outer circumferential surface may be heated, and the laundry held in the drum 30 may be exposed to the heat uniformly. As a result, even though the induction heater 70 is installed in one of upper, lower and lateral regions of the outer circumferential surface, the entire region of the outer circumferential surface of the drum 30 may be heated in the laundry apparatus 1.

In addition, all of the laundry may not need to be submerged in the wash water in the laundry apparatus to perform a laundry soaking treatment. Accordingly, the laundry apparatus may save wash water. Also, the laundry need not be submerged in the wash water in the laundry apparatus to raise the temperature so as to perform a laundry sterilizing treatment. Accordingly, the laundry apparatus may save wash water. Further, this embodiment of the laundry apparatus may not need to heat wash water with a high specific heat and may then save energy.

This embodiment of the laundry apparatus may omit a process of supplying wash water to raise the temperature of the laundry. Accordingly, the laundry apparatus may simplify the washing course and reduce an overall washing time. Still further, this embodiment of the laundry apparatus may omit a structure of the heater provided in the lower portion of the tub to heat wash water. Accordingly, the laundry apparatus may be capable of simplifying a structure and increasing a volume of the tub effectively.

Figure 2A:
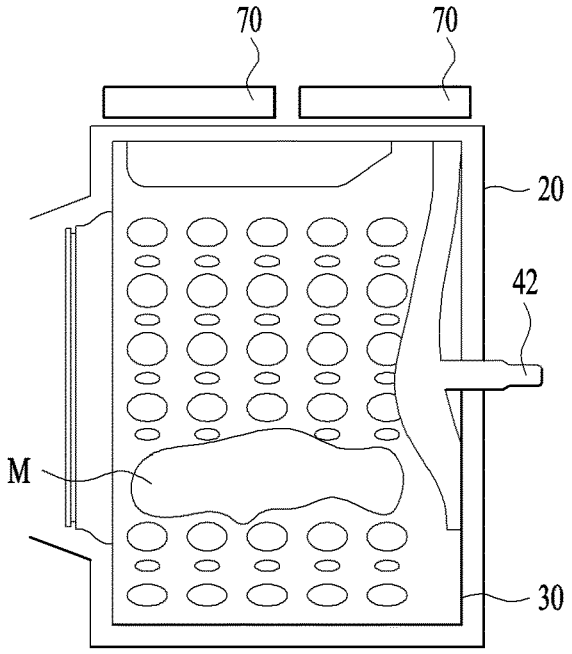
FIG. 2A and FIG. 2B illustrate the induction heater in accordance with the embodiment.
Figure 2B:
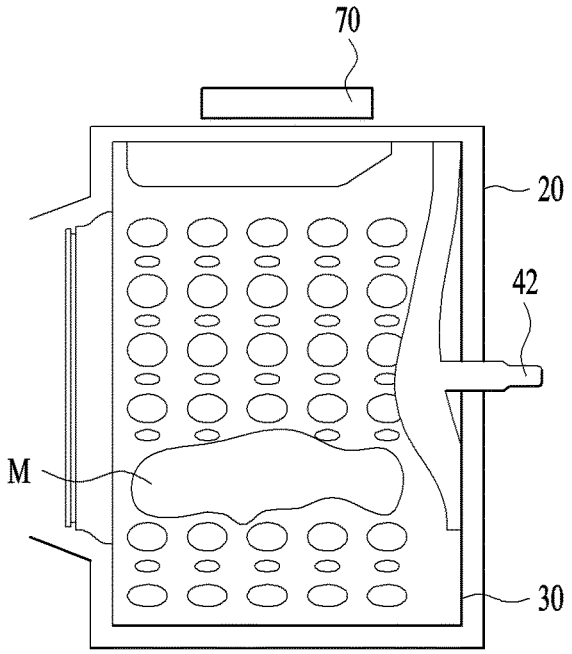

FIG. 2A and FIG. 2B illustrate the laundry apparatus without the cabinet 10 and the tub 20. FIG. 2 shows that the induction heater 70 may be arranged in or at the outer circumferential surface of the tub 20, over or above an upper surface of the drum 30. However, embodiments are not limited thereto and may include the induction heater 70, which is provided in the outer circumferential surface of the tub 20, corresponding to a lateral surface or lower surface of the drum 30.

As shown in FIG. 2A, two or more induction heaters 70 may be arranged from or along a front to a back side. The plurality of the induction heaters 70 may be arranged on the outer circumferential surface of the tub 20 side by side and the outer circumferential surface of the drum 30 may be heated uniformly. Energy efficiency may be enhanced by selectively driving a front induction heater 70 and a rear induction heater 70 according to location of the laundry.

For example, a user may load a small amount of laundry in a front portion of the drum 30, and the user may load a large amount of laundry in the drum 30 uniformly. If a small amount of laundry M is loaded in the drum 30, only the front induction heater 70 may be driven. If a large amount of the laundry M is loaded, both of the induction heaters 70 may be driven. The induction heaters 70 may be selectively driven according to an occasion.

As shown in of FIG. 2B, the induction heater 70 may be provided corresponding to a central portion of the drum 30. For example, when one induction heater 70 is provided, the induction heater 70 may be arranged in or at the outer circumferential surface of the tub 20, corresponding to a center of the drum 30. If located near the front portion, the induction heater 70 may be likely to heat a gasket or a door provided between the tub 20 and the drum 30. If located near the rear portion, the induction heater 70 may be likely to heat the drive unit 40 and the shaft 42. Other components of the laundry apparatus might be unnecessarily heated, causing energy waste, and also the other components might be overheated enough to be deformed or malfunctioned. Accordingly, the induction heater 70 may be provided in or at a center, not biased to the front or rear portion, so as to prevent such problems.

The plurality of induction heaters 70 or one induction heater 70 may be spaced apart some or a predetermined distance from a front end of the drum 30 and a back end of the drum 30. If provided corresponding to the front end of the drum 30 in a vertical direction, the plurality of induction heater(s) 70 might heat a door, a circulation duct, or an injection nozzle, which may be provided between the drum 30 and the tub 20. If provided corresponding to the back end of the drum 30 in a vertical direction, the plurality of induction heater(s) 70 might heat the drive unit 40 of the drum 30. Thus, the plurality of inductions 70 may be provided spaced apart some distance from the front end or back end of the drum 30, in order to prevent other components of the laundry apparatus from being heated by the eddy current.

Figure 3A:
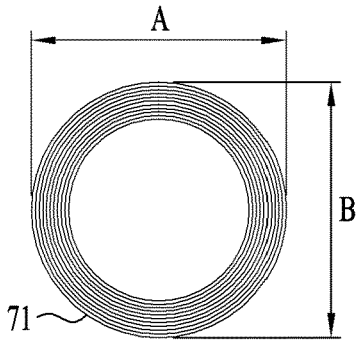
FIGS. 3A, 3B and 3C are diagrams illustrating embodiments of a coil arrangement.
Figure 3B:
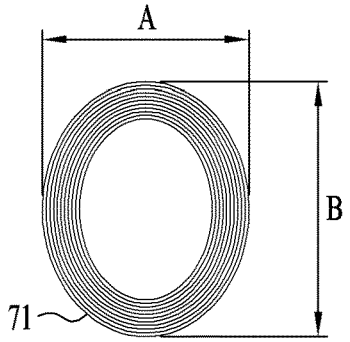

FIG. 3A and FIG. 3B are diagrams illustrating the coil 71 wound in the coil loading portion 72, viewed from above. Referring to FIG. 3A, the coil 71 may be wound in the coil loading portion 72 at least one time, while keeping a circular shape. One or a first radius along a forward/backward direction of the tub 20 may be referred to as CB' and another or a second radius along a width direction of the tub 20 may be referenced to as CA'. A length A may be equal to a length B.

Referring to FIG. 3B, the coil 71 may be provided in the coil loading portion 72 in an oval shape. A length B may be longer than a length A. The coil 71 may be arranged longer in the forward/backward direction of the tub 20 so as to heat the front and rear portions of the tub uniformly.

Figure 3C:
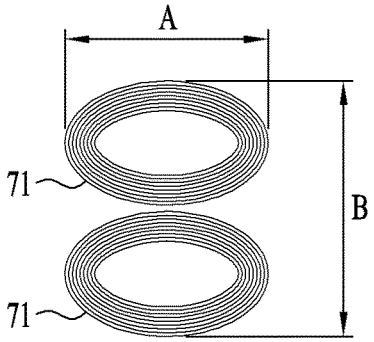

Referring to FIG. 3C, a plurality of coils 71 may be wound in the coil loading portion 72 at least one time, spaced apart some or a predetermined distance from each other. A major axis may be provided in a lateral direction and one or more coils 71 may be further arranged in a minor axis, so as to heat front, rear and both lateral portions of the drum 30.

Figure 4A:
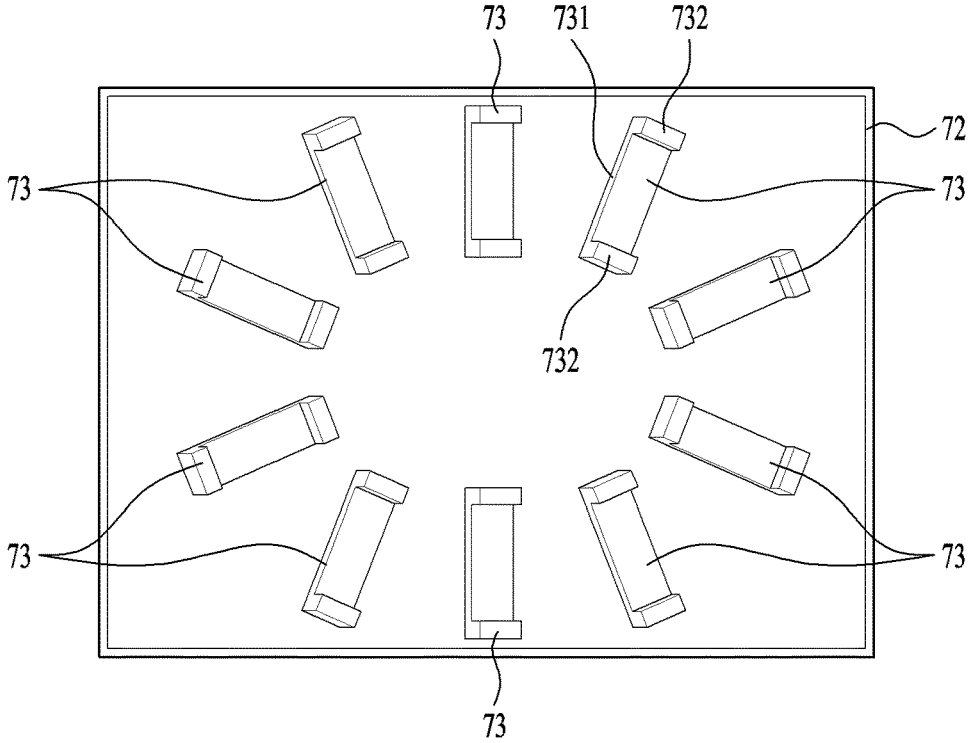
FIG. 4A to FIG. 5C are diagrams illustrating an embodiment in which a coil may be wound around the induction heater.
Figure 4B:
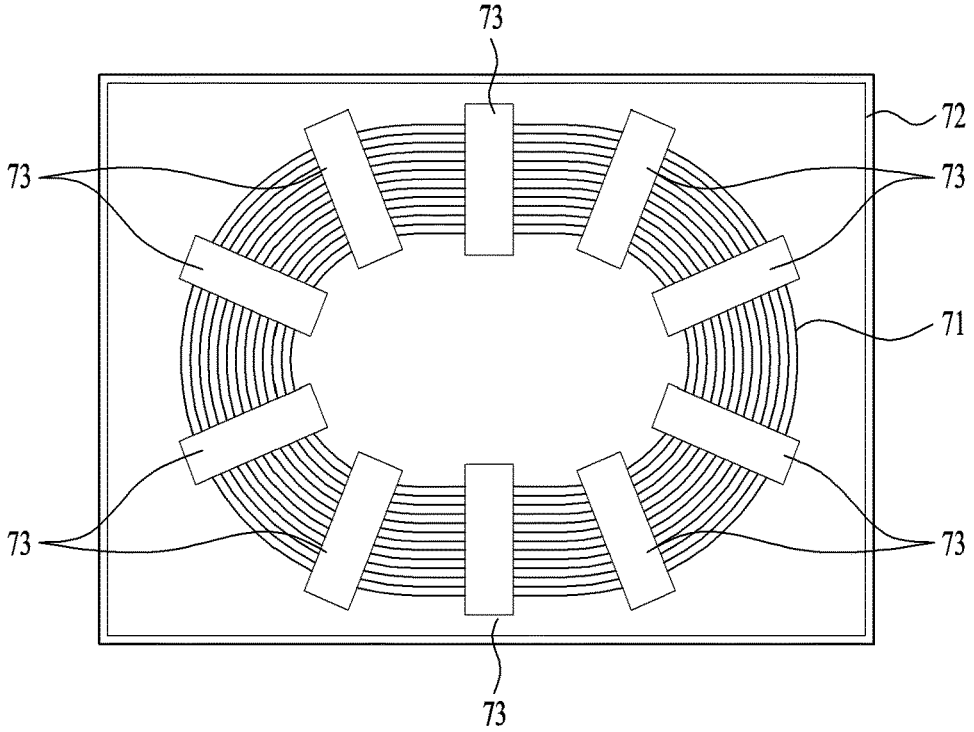

FIG. 4A and FIG. 4B illustrate a way to fixedly wind the coil 71 in the induction heater 70. As mentioned above, the coil loading portion 72 may be provided in a box shape with an open bottom side so as to prevent the coil 71 from getting separated from the tub 20 by external vibration. The coil loading portion 72 may provide the open side with a predetermined space for installing the coil 71.

FIG. 4A illustrates the coil loading portion 72, viewed from below. The coil loading portion 72 may include a plurality of coil fixing members 73 spaced apart in a radial direction to facilitate winding of the coil 71 while maintaining a shape thereof. The coil fixing member 73 may include a support body 731 having a bar shape and connecting ribs 732 that project from both ends of the support body 731.

The support body 731 may be attached to one surface of the coil loading portion 72 or integrally formed with one surface of the coil loading portion 72. The coil fixing member 73 may be provided in one surface of the coil loading portion 72 in diverse ways, only if guiding the winding of the coil 71. The coil 71 may be wound around the coil fixing members 73 at least one time. The coil fixing members 73 may facilitate the winding of the coil 71. Also, the coil fixing members 73 may function to keep the shape of the coil even after the winding without deformation or distortion.

FIG. 4B illustrates the coil loading portion 72, viewed from above. The coil 71 may start to be wound along an inner projected region of the coil fixing member 73 and winding may end when reaching an outer projected region of the coil fixing member 73. Accordingly, the coil 71 may be stably fixed in the coil loading portion 72 while keeping the shape.

While it has been described that the coil 71 may be wound in the circular or oval shape, it may be advantageous to heat the outer circumferential surface of the drum 30 so that the coil 71 may be wound in a shape which looks as similar to a rectangle as possible. The drum 30 may be provided in the cylindrical shape, and a cross sectional area, which is shown after cutting the outer circumferential surface of the drum 30 in a horizontal direction with respect to the ground, may be rectangular.

Accordingly, when the coil 71 is wound in the rectangular shape corresponding to the cross section area of the outer circumferential surface of the drum 30, a portion which is not affected by the magnetic field generated in the coil 71 may be reduced enough to heat the drum 30 effectively.

However, it may be difficult in reality to wind the coil 71 in a perfect rectangular shape, considering a material of the coil 71 and a winding process of the coil 71. The coil 71 may be wound in a track shape, which may be as close to the rectangular shape as possible. For example, the coil 71 wound in the front and rear portions of the tub 20 may have a curved shape. The coil 71 wound in lateral sides connecting the front and rear portions with each other may have a linear shape.

Figure 5A:
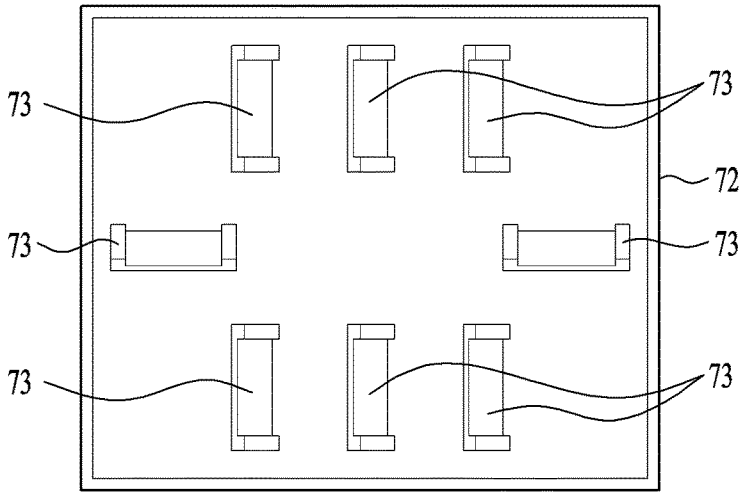
Figure 5B:
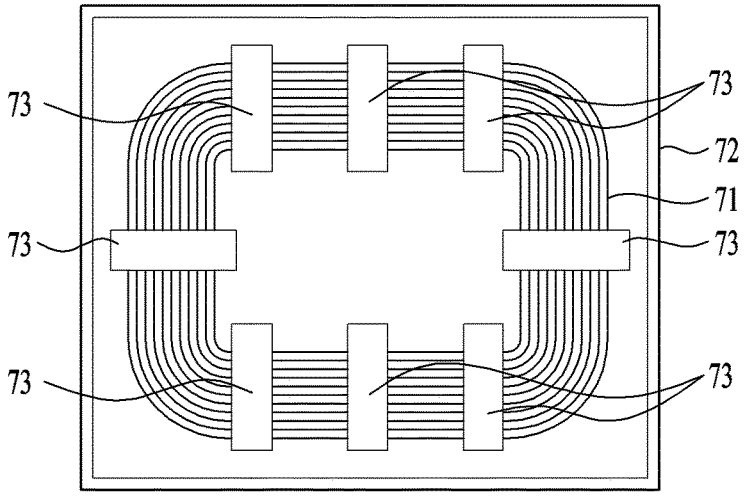
Figure 5C:
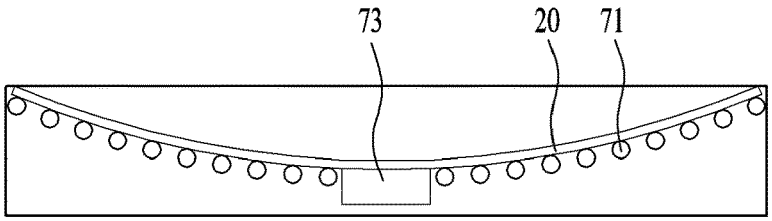

FIG. 5C to FIG. 5C illustrate one embodiment of the coil 71 wound in the track shape. Referring to FIG. 5A, the coil fixing members 73 may be arranged not in a radial shape. Some fixing members 73 may be arranged in upper and lower areas shown in the drawing in a linear shape and others arranged in both lateral sides may be arranged vertical with respect to those linearly arranged in the upper and lower areas. If the front direction of the tub 20 is defined as a left or first direction and the rear direction as a right or second direction, some coil fixing members 73 provided in both lateral sides of the tub 20 may be linearly arranged. The others provided in the front and rear portions of the tub 20 may be vertically arranged with respect to the linearly arranged coil fixing members.

Referring to FIG. 5B, the coil 71 may be wound in the coil fixing members 73 linearly arranged along the lateral sides of the tub 20 and have a curvature to be wound along the coil fixing members 73 arranged along the front and rear portions of the tub 20. As a result, the coil 71 may be wound in the track shape along the arranged coil fixing members 73. The coil 71 may then generate the eddy current in a wider area of the outer circumferential surface of the drum 30.

One coil fixing member arranged in the outer circumferential surface of the tub 20 vertically with respect to the shaft of the drum 30 may be a first coil fixing member. Another coil fixing member arranged horizontally with respect to the shaft of the drum 30 may be a second coil fixing member.

FIG. 4A to 5C illustrate that the coil 71 may be wound in the shape parallel to the ground. Alternatively, a surface of the coil loading portion 72 where the coil fixing members 73 are provided may have a curvature to correspond to a radius of a curvature of the drum 30. The coil 71 may be wound according to the curvature of the coil loading portion 72 only to be corresponding to the radius of the curvature of the drum 30. Accordingly, extending from a center of the coil 71, a gap between the coil 71 and the drum 30 may be kept regular and the eddy current with uniform strength may be generated in the outer circumferential surface of the drum 30. In other words, the outer circumferential surface of the drum 30 may be uniformly heated.

When the coil 71 is wound in the coil fixing members 73 as shown in FIG. 4A to FIG. 5C, the coils of the coil 71 may be likely to contact each other too closely, causing a short circuit. To prevent the short circuit, an insulator film may be additionally provided on the coil 71, but the coil 71 might overheat because of its own resistance or it may become difficult to cool the coil 71, so that a danger of the insulator film melting may be contained. In addition, extra costs may be incurred if an insulating coat is wound on the coil 71 to form the insulator film.

To prevent that, the coil 71 wound in the induction heater 71 may be spaced apart some distance from each other. When wound in the induction heater 70 from the front portion to the rear portion of the tub 20 at least one time, the coil 71 may be distant not to contact with each other. As a result, there may be no danger of short circuiting because the coils of coil 71 does not contact each other and heat of the coil 71 may be cooled easily. Moreover, an area where the coil 71 is wound may become wider so that a wider area of the outer circumferential surface of the drum 30 may be heated.

Figure 6A:
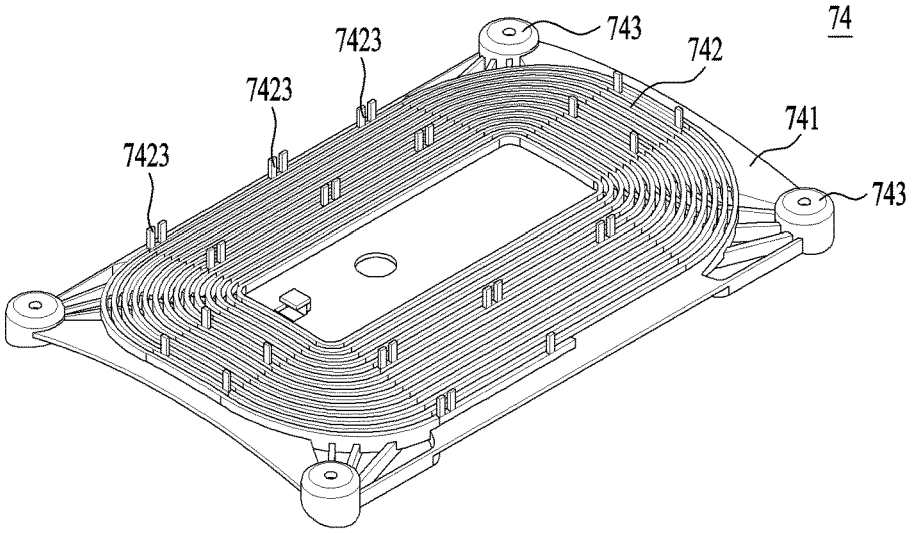
FIGS. 6A, 6B and 6C are diagrams illustrating another embodiment in which a coil may be wound around the induction heater.
Figure 6B:
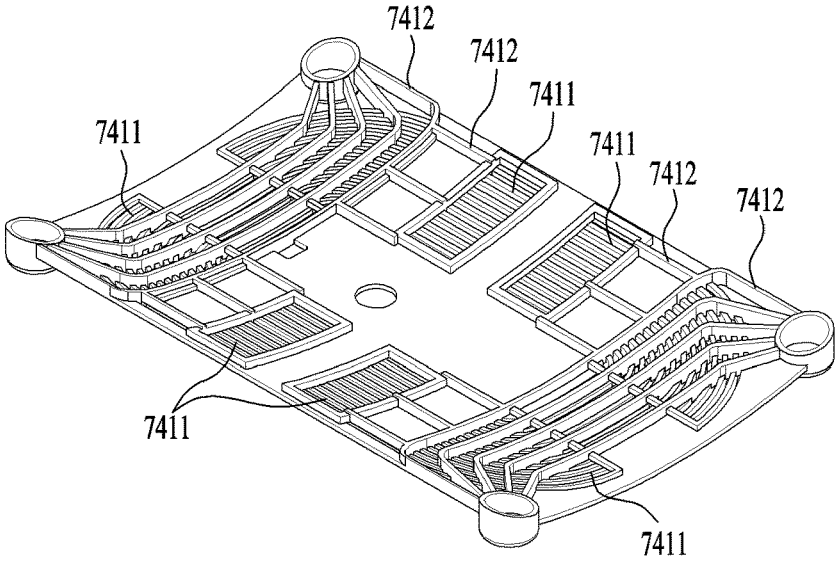
Figure 6C:
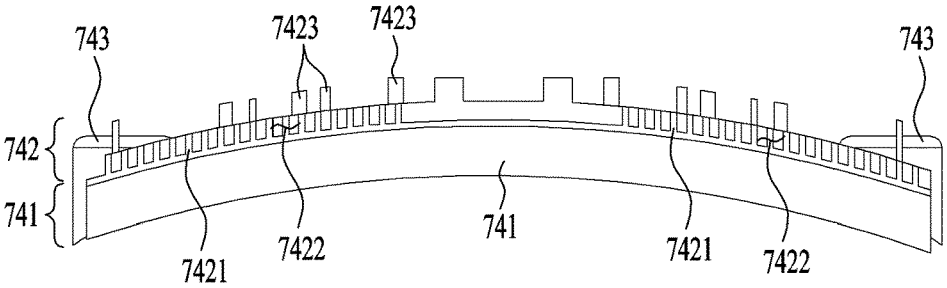

FIG. 6A to FIG. 6C illustrate one embodiment for keeping a preset or predetermined gap between the coils 71. Referring to FIG. 6, the induction heater 70 may further include coil arranging portion 74 to arrange the coils 71 spaced some distance apart from each other, when the coil 71 is wound in the induction heater 70 along the forward and backward direction of the tub 20 at least one time. The coil arranging portion 74 may be loaded in the coil loading portion 72. The coil arranging portion 74 may be provided as an independent part from the tub 20 to be coupled to the outer circumferential surface of the tub 20 or integrally formed with the tub 20.

FIG. 6A and FIG. 6B illustrate a structure in which the coil arranging portion 74 may be coupled to the outer circumferential surface of the tub 20 as an independent part. However, as mentioned above, embodiments may not exclude the example of the coil arranging portion 74 integrally formed with the tub 20 by injection molding.

The coil arranging portion 74 may include a coil arranging plate 741 provided in the outer circumferential surface of the tub 20. The coil 71 may be wound around the coil arranging plate 74. In other words, the coil 71 may go back and forth in the tub 20 to be wound around the coil arranging plate 74 at least one time. The coil arranging plate 741 may be provided on a plane with the cabinet 10 or include a coupling material or member 743 that attaches to tub coupling members 26 on the outer circumferential surface of the tub 20.

The coil arranging plate 741 may be supported by the coupling member 743, spaced a distance apart from the tub 20, so as to prevent direct exposure to the vibration of the tub 20, and the direct exposure of heat and magnetic field generated in the coil 71 to the tub 20 as well. A reinforcing rib may be further provided to compensate for a gap between the coil arranging plate 741 and the outer circumferential surface of the tub 20 and to reinforce a strength of the coil arranging plate 741. The tub 20 may be provided in the cylindrical shape and the coil arranging plate 741 may be in parallel with the outer circumferential surface of the tub 20. In other words, the coil arranging plate 741 may be a plate having a same curvature as the tub 20. The coil arranging plate 741 may be in complete surface-contact with the outer circumferential surface of the tub 20. In this instance, the gap between the coil 71 and the tub 20 may be minimized to prevent dispersion of the magnetic field.

The coil arranging plate 741 may include a coil arranging line 742 that guides the coil 71 to be wound in one surface at least one time. The coil arranging line 742 may guide the coil 71 to be wound such that coils of the coil 71 may be spaced a distance apart from each other. The coil arranging line 742 may be a combination of fixing ribs 7421, which may project from the coil arranging plate 741. The fixing ribs 7421 may be formed in one of circles, ovals, or tracks which may share a center. An extended line of the fixing ribs 7421 may be the circle, oval, or track.

FIG. 6A illustrates the coil arranging line 742, which may be a combination of the fixing ribs 7421 formed in the track shape with a linear area and a curved area. The coil 71 may be arranged in the coil arranging plate 741, wound along the outermost fixing rib 7421 or the innermost fixing rib 7421. The fixing rib 7421 may not only guide the winding of the coil 71 but also keep a distance between coils of the coil 71 during the winding process.

An accommodating portion 7422 may be provided between a fixing rib 7421 and a next neighboring fixing rib 7421. The coils of the coil 71 may be accommodated by the accommodating portion 7422 between each two fixing ribs 7421 arranged spaced apart from each other. The fixing ribs 7421 may be spaced apart only to form the accommodating portions 7422.

The coil arranging portion 74 may further include a projected rib 7423 that projects from one of the fixing ribs 7421. The projected rib 7423 may project far from a top of one of the fixing ribs 7421. A plurality of the projected ribs 7423 may be provided, which function to keep a gap between the fixing ribs 7421 and the coil accommodating portions 72. The projected ribs 7423 may be used to estimate relative positions of the fixing ribs 7421.

For example, it may be estimated based on the projected ribs 7423 whether the fixing ribs 7421 may be located at an inside or outside. That makes it easy to figure out a number of times the coils 71 are being wound and a winding area, when the coils 71 are wound around the fixing ribs 7421.

FIG. 6B is a diagram illustrating a rear surface of the coil arranging plate 741 and FIG. 6C is a sectional diagram of the coil arranging plate 741. The coil arranging plate 71 may include a plurality of penetrating holes 7411. One or more penetrating holes 7411 may be formed in the coil arranging plate 741. The penetrating holes 7411 may be arranged in symmetry, when the coil arranging plate 741 is rectangular, and along one surface and another opposite surface of the coil arranging plate 741.

The penetrating holes 7411 provided in corners of the coil arranging plate 741 may be formed in a shape of a ¼ of a circle and the penetrating holes 7411 provided in another region may be formed in a rectangular shape. The penetrating holes 7411 may be provided in a rear surface of the coil arranging plate 741 where the fixing ribs 7423 may be provided. Accordingly, when the coil 71 wound in the accommodating portions 7422 is heated by electrical resistance, heat of the coil 71 may be emitted to prevent damage of the coil arranging plate 741.

The coil arranging plate 741 may include reinforcing ribs 7412 provided in the rear surface to reinforce a strength and rigidity of the rear surface having the penetrating holes 7411.

Some of the fixing ribs 7421 provided in the region having the penetrating holes 7411 may not be supported nor fixed. The reinforcing ribs 7412 may fix the fixing ribs 7421 and reinforce the strength of the fixing ribs 7421.

Different from what is shown in FIG. 6A to FIG. 6C, the accommodating portions 7422 may be provided as accommodating grooves formed by recessing the coil arranging plate 741 in the spaced gap of the fixing ribs 7421. In this instance, the accommodating groove may form the accommodating portion 7422. The fixing ribs 7421 may be omitted and only the accommodating grooves 7422 recessed from the coil arranging plate 741 may be provided. The accommodating grooves 7422 may be formed on the coil arranging plate 741.

The accommodating groove 7422 may be carved into the coil arranging plate 741. An intaglio treatment may be used to form the accommodating grooves 7422 on the coil arranging plate 741. The accommodating grooves 7422 may be formed in one of a circle, oval, or track shapes with expanded sizes so that the coils 71 may be wound along the accommodating grooves 7422 at least one time, spaced apart from each other.

The coils of the coil 71 may be wound in the coil arranging plate 741, spaced some distance apart from each other, and the spaced distance may be uniform. In other words, the coils of the coil 71 may be arranged in the coil arranging plate 741 at equidistant intervals. For that, the accommodating portions 7422 may be spaced a preset or predetermined distance from each other in the coil arranging plate 741. The fixing ribs 7421 may project from the coil arranging plate 741 in one of the circle, oval, or track shapes spaced a preset or predetermined distance from each other.

Figure 7A:
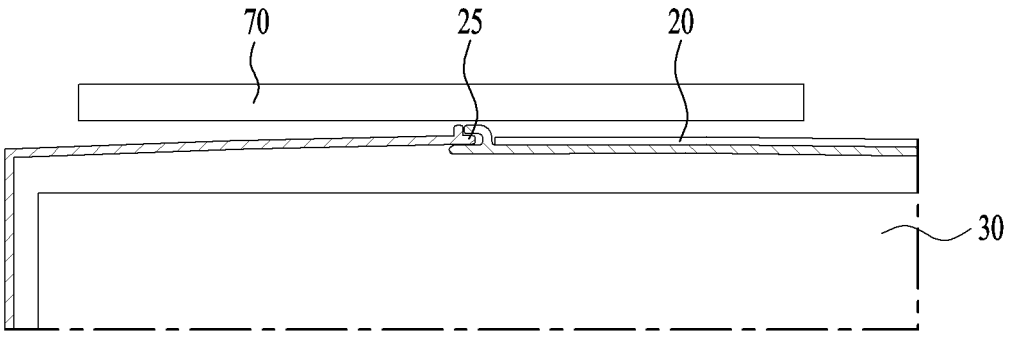
FIGS. 7A and 7B are diagrams illustrating an embodiment including a plurality of induction heaters.
Figure 7B:
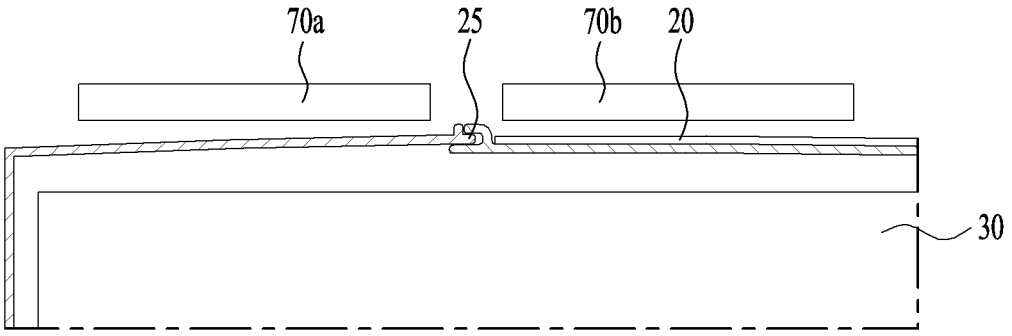

FIG. 7A and FIG. 7B illustrate a way of installing the induction heater 70 when the tub 20 is assembled. The tub 20 may be provided in the cylindrical shape. The tub 20 may be fabricated in a cylindrical shape defining an internal space. However, only a half of the cylindrical shape may be fabricated and another half may be fabricated separately, so as to assemble them into one tub.

The tub 20 may be provided as an assembly type to facilitate a fabrication process. When provided as the assembly type, the tub 20 may include a front tub 21 defining a front of the tub 20 and holding a front portion of the drum 30 and a rear tub 22 holding a rear portion of the drum 30. The front tub 21 and the rear tub 22 may be coupled to each other by a connection unit or connector 25. The connection unit 25 may be provided as any type of connection unit as long as it is capable of connecting one end of the front tub 21 with one end of the rear tub 22. The tub 20 may have a projected portion where the connection unit 25 may be provided.

As shown in FIG. 7A, the induction heater 70 may be spaced a distance apart from the tub 20 and not in contact with the connection unit 25. Alternatively, induction heaters 70 may be provided in the front tub 21 and the rear tub 22, respectively, as shown in FIG. 7B.

The induction heaters 70 may include a first induction heater 70*a* provided in or at an outer circumferential surface of the front tub 21 and a second induction heater 70*b* provided in or at an outer circumferential surface of the rear tub 22. The induction heaters 70 made of the first and second induction heaters like the tub 20 may be affected by the connection unit 25. When provided as one unit, the induction heater 70 has to be spaced a distance apart from the tub 20 because of the connection unit 25 (see FIG. 7A). When provided as two units, the two induction heaters 70 may be closer to the tub 20 (see FIG. 7B). The induction heater 70 may be positioned closer to the drum 30, so as to transfer the generated magnetic field to the drum 30 more effectively.

The front tub 21 and the rear tub 22 may be provided in symmetry so that the first induction heater 70*a* provided in or at the front tub 21 and the second induction heater 70*b* provided in or at the rear tub 22 may be provided in symmetry. The first induction heater 70*a* and the second induction heater 70*b* may be in symmetry with respect to a vertical direction to the ground from a center of the drum 30. Accordingly, the induction heaters 70 may heat the laundry held in the drum 30 uniformly.

Figure 8:
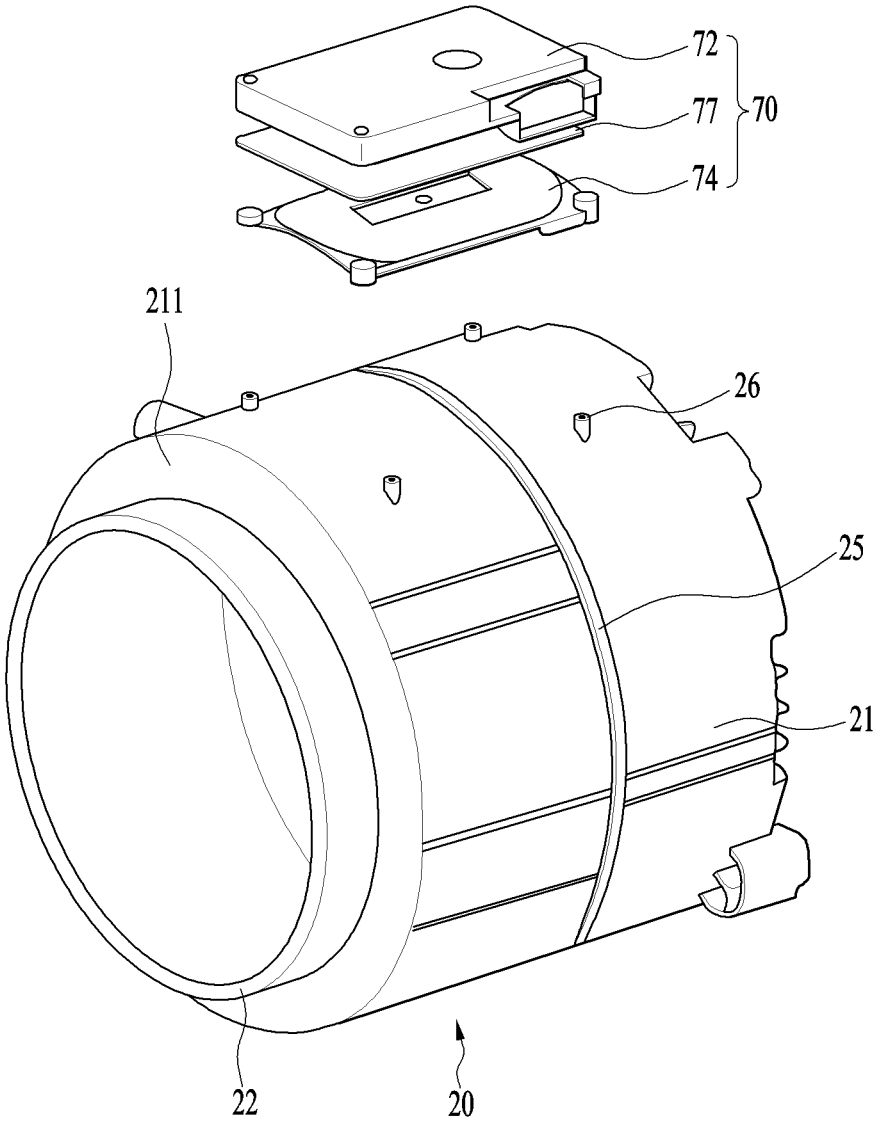
FIG. 8 is a diagram illustrating an embodiment in which the induction heater may control a direction of a magnetic field.

Hereinafter, a structure for adjusting a direction of the magnetic field will be described referring to FIG. 8. A conventional laundry apparatus may include a controller that rotates the drive unit 40, manipulates a control panel provided in the cabinet 10 and controls the courses, and a diverse cable. The induction heater 70 may be configured to heat the drum 30 based on the magnetic field generated in the coil 71. If the magnetic field emitted from the coil 71 is exposed to the controller and the cable provided in the laundry apparatus, an abnormal signal may be generated in the controller and the cable. In addition, electronic appliances, such as the controller, the cable, and the control panel may be vulnerable to the magnetic field. The magnet field generated in the induction heater may be exposed only to the drum.

For that, the induction heater 70 may further include a shut-off member 77 to expose the magnetic field generated in the coil 71 only to the drum 30. The shut-off member 77 may be provided as a ferromagnetic material and be capable of shutting off the magnetic field generated in the coil 71. The shut-off member 77 may be coupled to an upper portion of the coil arranging plate 741 and attached to an inner surface of the coil accommodating portion 71. The shut-off member 77 may be formed in a flat plate shape.

Alternatively, the coil accommodating portion 72 may be formed of a ferromagnetic material to function as the shut-off member. The coil accommodating portion 72 may be provided in a box shape with one open side. When it accommodates the coil 71 or the coil arranging plate 74, the coil accommodating portion 72 may be capable of guiding the magnetic field only to the drum 30. At this time, the shut-off member 77 may be omitted. Although not shown in the drawing, the controller may adjust an amount of currents which flows to the coil 71 and control the currents to be supplied to the coil 71.

The controller may further include at least one of a thermostat or a thermistor that cuts the current of the coil, when too may currents flow to the coil 71 or a temperature of the coil 71 rises to a preset or predetermined value or more. The thermostat or thermistor may be any type as long as it is capable of cutting off the currents flowing to the coil 71.

As described above, the embodiments may be capable of generating the magnetic field, without the coils of the coil 71 contacting each other. Accordingly, short circuiting of the coils of the coil 71 may be prevented and the coils of the coil 71 arranged spaced apart from each other may not be overheated. Furthermore, embodiments need not heat the wash water after supplying wash water to the tub 20 to perform a sterilizing treatment, a drying, or a laundry soaking treatment for the laundry held in the drum 30. In contrast, all of the laundry has to be submerged in the wash water and the wash water may be heated to indirectly heat the laundry in the conventional laundry apparatus.

However, the laundry apparatus in accordance with embodiments may heat the laundry held in the drum 30 by directly heating the drum 30. Accordingly, all of the laundry may not have to be submerged in the wash water. Also, the drum 30 may be uniformly heated by the coil 71 and the laundry may be uniformly heated. Even when the laundry is piled thick or biased enough not to contact with hot air directly, the drum 30 may be rotated and the laundry may be agitated. After that, the induction heater 70 may be put into operation and the laundry may be able to be heated uniformly. In other words, the laundry apparatus in accordance with the embodiments may obtain the effect of laundry soaking or sterilizing even if the laundry is submerged in the wash water.

The laundry apparatus may be capable of raising the temperature of the laundry even while heating the wash water. The laundry apparatus may be capable of drying the laundry uniformly even when the laundry is piled thick or entangled. The laundry apparatus may be capable of enhancing washing and drying efficiency and saving the wash water.

Embodiments disclosed herein may overcome disadvantages of a conventional laundry apparatus or twin laundry machine, noted above. Embodiments disclosed herein provide a laundry apparatus which may be capable of soaking or sterilizing laundry even unless the laundry is submerged in wash water. Embodiments disclosed herein also provide a laundry apparatus which is capable of raising the temperature of laundry even without heating wash water.

Embodiments disclosed herein further provide a laundry apparatus which is capable of drying the laundry uniformly even if laundry is entangled or a large amount of laundry is loaded. Embodiments disclosed herein furthermore provide a laundry apparatus which may have a high energy and wash-water consumption efficiency.

Embodiments of the present disclosure also provide a laundry apparatus which may not generate a short circuit in a coil used in heating a drum. Embodiments additionally provide a laundry apparatus in which a magnetic field generated in the coil may not interfere in other components provided therein. Embodiments disclosed herein also provide a laundry apparatus including a coil which may not be overheated by its resistance even if it generates heat.

Embodiments disclosed herein provide a laundry apparatus that may include a cabinet, a tub provided in the cabinet and defining an internal space, with an opening formed in a front thereof, a drum rotatably provided in the internal space of the tub and made of a conductor, and an induction heater or induction unit provided in an outer circumferential surface of the tub and heating the drum by generating an electromagnetic field. The induction heater may include a coil that generates an eddy current in the drum by generating a magnetic field, using an electric current supplied thereto, and a coil arranging portion provided in the outer circumferential surface of the tub and guiding the coil to be wound around front and rear portions of the tub at least one time, spaced a preset or predetermined distance apart from each other.

The coil arranging portion may further include a coil arranging plate provided in the outer circumferential surface of the tub, and the coil may be wound in the coil arranging plate. The coil arranging plate may be a flat plate provided in parallel with the cabinet, and the coil arranging plate may include a coupling member attached to the outer circumferential surface of the tub, and a reinforcing rib capable of reinforcing a gap between the coil arranging plate and the outer circumferential surface of the tub. The tub may be provided in a cylindrical shape, and the coil arranging plate may be provided in a shape parallel with the outer circumferential surface of the tub.

The coil arranging plate may be in surface-contact with the outer circumferential surface of the tub. The coil arranging plate may include a coupling member attached to the outer circumferential surface of the tub, and a reinforcing rib capable of maintaining a gap between the coil arranging plate and the outer circumferential surface of the tub.

The coil arranging plate may further include a plurality of accommodating grooves recessed from the coil arranging plate and accommodating the coil. The plurality of the accommodating grooves may be provided in one of a circle, oval, or track shapes with expanded sizes, and the coil may be wound along the accommodating grooves at least one time, spaced a distance apart from each other.

The coil arranging portion may include a plurality of fixing ribs projected from the coil arranging plate in a looped curve, and the plurality of the fixing ribs may be provided in one of a circle, oval, or track shape with expanded sizes, and the coil may be wound along the fixing ribs at least one time, spaced a distance apart from each other. The coil arranging portion may further include a plurality of accommodating portions that accommodates the coil, and the accommodating portions may be arranged between the fixing ribs.

The laundry apparatus may further include a plurality of projected ribs that project from the fixing ribs, spaced a distance apart from each other. The induction heater may be provided between a front portion of the drum and a rear portion of the drum, spaced a distance apart from one end of the front and one end of the rear portion of the drum. The tub may include a front tub holding a front portion of the drum, and a rear tub holding a rear portion of the drum, and the induction heaters may be provided in the front tub and the rear tub, respectively.

The induction heater may further include a shut-off member provided in an upper portion of the coil arranging portion and shutting off the magnetic field generated in the coil. The shut-off member may be provided in a box shape with an opening formed in one side and concentrate the magnetic field generated in the coil only toward the opening. The shut-off member may be made of a ferromagnetic material. The shut-off member may be made of plastic.

The laundry apparatus may further include a controller that supplies currents to the coil and rotates the drum. The controller may include at least one of a thermostat and a thermistor for shutting off the current supplied to the coil, when too much current is supplied to the coil or the temperature of the coil rises to a preset or predetermined value or more.

The coil arranging plate may include one or more penetrating holes that exhaust the heat generated in the coil. The coil arranging portion may include a plurality of coil fixing members arranged in the outer circumferential surface of the tub in a radial direction, spaced a distance apart from each other, and the coil fixing member may include a support body formed in a bar shape, and a plurality of connecting ribs that extends from one surface of the support body in a vertical direction to be coupled to the tub. The coil may be wound between the connecting ribs.

The coil fixing member may include a first coil fixing member provided in the outer circumferential surface of the tub in a vertical direction with respect to the shaft of the drum, a second coil fixing member provided in the outer circumferential surface of the tub in a horizontal direction with respect to the shaft of the drum, and the coil may be wound in a similar shape to a rectangle.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry apparatus comprising:

a cabinet;

a tub provided in the cabinet and defining an internal space, the tub having an opening formed in a front of the tub, the tub including the front and a rear;

a drum rotatably provided in the internal space of the tub and being made of a conductor; and an induction heater provided at an outer circumferential surface of the tub, wherein the induction heater heats the drum by generating an electromagnetic field and includes:

a coil that uses a supplied electric current to generate an eddy current in the drum by generating a magnetic field, the coil including a plurality of coils; and a coil arranging portion provided at the outer circumferential surface of the tub, the coil arranging portion to arrange the coils such that each of the coils is wound at least once in a forward direction of the tub and at least once in a backward direction of the tub with a pair of parallel lines with a predetermined length, wherein the backward direction is a direction from the front to the rear of the tub, and the forward direction is a direction from the rear to the front of the tub.

2. The laundry apparatus of claim 1, wherein the coil arranging portion includes:

a coil arranging plate provided at the outer circumferential surface of the tub, wherein the coil is wound on the coil arranging plate.

3. The laundry apparatus of claim 2, wherein the coil arranging plate is a flat plate that extends in parallel with the cabinet, and wherein the coil arranging plate includes:

a coupling member attached to the outer circumferential surface of the tub; and a reinforcing rib that maintains a gap between the coil arranging plate and the outer circumferential surface of the tub.

4. The laundry apparatus of claim 2, wherein the tub has a cylindrical shape, and the coil arranging plate is provided in a shape so as to extend parallel with the outer circumferential surface of the tub.

5. The laundry apparatus of claim 4, wherein the coil arranging plate is in surface-contact with the outer circumferential surface of the tub.

6. The laundry apparatus of claim 4, wherein the coil arranging plate includes:

a coupling member attached to the outer circumferential surface of the tub; and a reinforcing rib that maintains a gap between the coil arranging plate and the outer circumferential surface of the tub.

7. The laundry apparatus of claim 2, wherein the coil arranging plate includes:

a plurality of accommodating grooves recessed in the coil arranging plate to accommodate the coil, wherein the plurality of accommodating grooves is in a rectangular shape, or is in a track shape, and the coils of the coil are wound along the accommodating grooves, and are spaced apart from each other.

8. The laundry apparatus of claim 2, wherein the coil arranging portion includes:

a plurality of fixing ribs that project from the coil arranging plate in a looped curve, wherein the plurality of fixing ribs is one of a circle shape, an oval shape, or a track shape, and the coils of the coil are wound spaced apart from each other along the fixing ribs.

9. The laundry apparatus of claim 8, wherein the coil arranging portion further includes:

a plurality of accommodating portions that accommodates the coil, wherein the plurality of accommodating portions is arranged between the plurality of fixing ribs.

10. The laundry apparatus of claim 9, further including:

a plurality of projected ribs spaced apart from each other, wherein the plurality of projected ribs project from the plurality of fixing ribs.

11. The laundry apparatus of claim 2, wherein the coil arranging plate includes:

one or more holes that release heat generated in the coil.

12. The laundry apparatus of claim 1, wherein the induction heater is provided between a front portion of the drum and a rear portion of the drum, spaced apart from one end of the front portion of the drum and one end of the rear portion of the drum.

13. The laundry apparatus of claim 1, wherein the tub includes:

a front tub forming a front portion of the drum; and a rear tub forming a rear portion of the drum, and wherein the induction heater is provided on the front tub and the rear tub.

14. The laundry apparatus of claim 13, wherein the front tub and the rear tub are coupled to each other by a connector, and the induction heater is spaced away from the connector.

15. The laundry apparatus of claim 1, wherein the induction heater further includes:

a shut-off member provided in an upper portion of the coil arranging portion and configured to shut off the magnetic field generated in the coil.

16. The laundry apparatus of claim 15, wherein the shut-off member is provided in a box shape with an opening formed in one side and concentrates the magnetic field generated in the coil only toward the opening.

17. The laundry apparatus of claim 16, wherein the shut-off member is made of a ferromagnetic material.

18. The laundry apparatus of claim 1, further including:

a controller that supplies currents to the coil and that determines rotation of the drum, wherein the controller includes at least one of a thermostat or a thermistor to shut off the current supplied to the coil when too many currents are supplied to the coil or a temperature of the coil rises to a predetermined value or more.

19. The laundry apparatus of claim 1, wherein the coil arranging portion includes:

a plurality of coil fixing members arranged in the outer circumferential surface of the tub in a radial direction, spaced apart from each other, wherein each of the plurality of coil fixing members includes:

a support formed in a bar shape; and a plurality of connecting ribs that extend from one surface of the support in a vertical direction to be coupled to the tub, and wherein the coil is wound between the plurality of connecting ribs.

20. The laundry apparatus of claim 19, wherein the plurality of coil fixing members includes:

a first coil fixing member provided at the outer circumferential surface of the tub in a vertical direction with respect to a shaft of the drum; and a second coil fixing member provided at the outer circumferential surface of the tub in a horizontal direction with respect to the shaft of the drum, and wherein the coil is wound in a rectangular shape.

* * * * *